US012751569B2

(12) United States Patent
Samaan

(10) Patent No.: US 12,751,569 B2
(45) Date of Patent: Oct. 6, 2026

(54) PROTECTIVE SHEET AND SECUREMENT ASSEMBLY

(71) Applicant: Purifas Holdings Pty Ltd, Bankstown (AU)

(72) Inventor: Ibrahim Samaan, Bankstown (AU)

(73) Assignee: Purifas Holdings Pty Ltd, Bankstown (AU)

( * ) Notice: Subject to any disclaimer, the term of this patent is extended or adjusted under 35 U.S.C. 154(b) by 106 days.

(21) Appl. No.: 18/403,145

(22) Filed: Jan. 3, 2024

(65) Prior Publication Data

US 2024/0130545 A1 Apr. 25, 2024
US 2024/0225321 A9 Jul. 11, 2024

Related U.S. Application Data

(63) Continuation-in-part of application No. 17/893,816, filed on Aug. 23, 2022, now abandoned.

(30) Foreign Application Priority Data

Aug. 23, 2021 (AU) ..... 2021221404
Sep. 27, 2021 (AU) ..... 2021107569

(51) Int. Cl.
*A47G 9/02* (2006.01)
*A47C 21/02* (2006.01)

(52) U.S. Cl.
CPC ..... *A47G 9/0246* (2013.01); *A47C 21/022* (2013.01)

(58) Field of Classification Search
CPC . A47G 9/00; A47G 9/007; A47G 9/02; A47G 9/0238; A47C 31/105; A47C 21/022; A61F 2013/15154; A61F 5/48; A61G 7/00; A61G 7/072; A61G 7/0502
See application file for complete search history.

(56) References Cited

U.S. PATENT DOCUMENTS 2,581,646 A 1/1952 Froelich
2,982,976 A 5/1961 Ferolito
3,466,679 A 9/1969 Hess
(Continued)

FOREIGN PATENT DOCUMENTS

CN 203815041 U 9/2014
CN 107690297 A * 2/2018 ..... A47C 31/105
WO 2016148686 A1 9/2016

OTHER PUBLICATIONS

Examination Report No. 1 issued in Australian Patent Application No. 2021221404 dated May 31, 2022.

*Primary Examiner* — Fredrick C Conley
(74) *Attorney, Agent, or Firm* — Weber Rosselli & Cannon LLP

(57) ABSTRACT

A protective sheet and securement assembly includes an elongate sheet adapted to cover an exposed or shared surface of a patient support in the form of a therapy bed, the elongate sheet including a loop component of a loop fastener wherein the loop component is integrated within an exposed surface of the elongate sheet, and a plurality of securement members adapted to mount to the therapy bed, the securement members each including a hook component of a hook fastener being configured for releasable inter-engagement with the loop component thereby anchoring the elongate sheet to the therapy bed.

18 Claims, 9 Drawing Sheets

(56) References Cited

U.S. PATENT DOCUMENTS

| | | | | | |
|---|---|---|---|---|---|
| 4,358,865 | A * | 11/1982 | Pagel | A47G 9/0238 | 428/910 |
| 4,979,251 | A * | 12/1990 | Lazar | A47G 9/0238 | 5/500 |
| 4,993,091 | A | 2/1991 | Draper et al. | | |
| 5,084,927 | A * | 2/1992 | Parkevich | A47G 9/02 | 5/939 |
| 5,984,158 | A * | 11/1999 | Frank | B65H 16/005 | 225/48 |
| 6,481,736 | B1 | 11/2002 | Chan | | |
| 7,287,289 | B1 * | 10/2007 | Hagopian | A61G 13/08 | 5/691 |
| 8,984,681 | B2 * | 3/2015 | Ponsi | A61G 7/1026 | 5/81.1 R |
| 2009/0119840 | A1 | 5/2009 | Seo | | |
| 2014/0165344 | A1 * | 6/2014 | Perez | B32B 7/08 | 428/221 |
| 2015/0064416 | A1 * | 3/2015 | Wolf | A61F 13/56 | 156/226 |
| 2015/0374568 | A1 * | 12/2015 | Miralles | A61G 7/02 | 4/452 |
| 2016/0022051 | A1 * | 1/2016 | Ebert | A47C 31/105 | 156/60 |
| 2016/0037769 | A1 * | 2/2016 | Murphy | A01N 25/34 | 424/409 |
| 2017/0164766 | A1 * | 6/2017 | Suchman | A47G 9/0246 | |
| 2020/0360216 | A1 * | 11/2020 | Larkin | A61B 46/40 | |
| 2023/0276962 | A1 * | 9/2023 | Wu | A47G 9/007 | 5/502 |

* cited by examiner

PROTECTIVE SHEET AND SECUREMENT ASSEMBLY

CROSS-REFERENCE TO RELATED APPLICATIONS

The present disclosure is a continuation-in-part of U.S. patent application Ser. No. 17/893,816, filed on Aug. 23, 2022, which claims the benefit of and priority to Australian Patent Application No. 2021107569, filed on Sep. 27, 2021, which is a divisional of Australian Patent Application No. 2021221404, filed on Aug. 23, 2021, the entire content of each of which is hereby incorporated by reference herein.

TECHNICAL FIELD

The present disclosure is broadly directed to a protective sheet and securement assembly. The disclosure is also generally directed to a protective sheet and dispenser assembly.

BACKGROUND

In medical and therapy environments it is known to cover a patient's bed with a disposable or single use bed sheet. The bed sheet is typically dispensed from a roll and, in a similar manner to hand towels, is torn off the roll at the required length. The disposable bed sheet is draped across exposed surfaces of the bed. Although relatively inexpensive, this style of disposable bed sheet is ineffective in (a) providing adequate coverage of the exposed bed surfaces, and (b) fitting to the bed without sliding relative to the bed and exposing previously covered surfaces. Another style of existing bed sheet intended to address these shortcomings of the low-cost disposable sheets are fitted bed sheets. Fitted bed sheets may be disposable or reusable and incorporate elastic or other means around their perimeter to fit about the edge of the bed, akin to fitted bed sheets used on a mattress. This style of fitted bed sheets are non-recyclable and relatively expensive and as such it is generally not commercially viable to use disposable fitted sheets in a hospital, clinical or other high volume environment. For this reason, the reusable version of the fitted sheet may be preferred although laundering and associated costs and associated environmental issues are a disincentive for deploying reusable fitted bed sheets. However, even after laundering, reusable sheets can harbour pathogens and particularly in a hospital environment there is a move toward single use.

SUMMARY OF DISCLOSURE

According to a first aspect of the present disclosure there is provided a protective sheet and securement assembly comprising:

- an elongate sheet adapted to cover an exposed or shared surface of a patient support, said elongate sheet including one of a hook or loop component of a hook and loop fastener wherein said hook or loop component is integrated within an exposed surface of said elongate sheet; and
- a plurality of securement members adapted to mount to the patient support, said securement members each including an opposite one of the hook or loop component of the hook and loop fastener, wherein the hook component is configured for releasable inter-engagement with the corresponding loop component thereby anchoring said elongate sheet to the patient support.

In aspects, the integrated hook or loop component of the elongate sheet occupies substantially all of one or both of the exposed surfaces of said elongate sheet. In embodiments, said integrated hook or loop component is an integrated loop component including entangled fibres being of a relatively fine construction for effective inter-engagement with the hook component of the securement members. In one non-limiting embodiment, the securement members are in the form of securement strips including the hook component integrated within one of its opposing faces. It is contemplated that the hook component may be of a relatively coarse construction compared with the relatively fine loop component of the elongate sheet.

In embodiments, the population density of entangled fibres of the loop component per square millimetre of the exposed surface of the elongate sheet is between approximately 10 to 100. It is envisioned that the population density of the hook component per square millimetre of the securement members may be between approximately 2 to 6.

In embodiments, an other of the opposing faces of the securement strips includes a self-adhesive layer for mounting of said strip to the patient support. In one non-limiting embodiment, the securement strips are each adapted for fastening to the patient support via staples or other fasteners. It is envisioned that the securement strips may each be adapted for adhesion to the patient support via glue or other adhesive materials.

In embodiments, the elongate sheet is formed in one piece from a recyclable and non-woven material. In one non-limiting embodiment, the recyclable material is disposable and effective in bacterial filtration.

In embodiments, the sheet is hot-rolled from multiple layers including at least one meltblown layer including the entangled fibres at least in part forming the integrated loop component of the elongate sheet. It is contemplated that the elongate sheet may be hot-rolled from opposing spunbound layers sandwiching either side of the meltblown layer. It is envisioned that the elongate sheet may be hot rolled from opposing spunbound layers sandwiching either side of a pair of the meltblown layers. In one non-limiting embodiment, the multiple layers may be at least in part melted together via discrete melt regions occupying a reduced area of the exposed surface of the elongate sheet including the integrated loop component thereby increasing an effective population of loop components for inter-engagement with the hook component of the securement members.

According to a second aspect of the disclosure there is provided a protective sheet and securement assembly comprising:

- an elongate sheet adapted to cover an exposed or shared surface of a patient support, said elongate sheet including a first fastener integrated within an exposed surface of said elongate sheet; and
- a plurality of second fasteners adapted to mount to the patient support, said second fasteners configured to releasably engage the first fasteners of the elongate sheet thereby anchoring said elongate sheet to the patient support.

According to a third aspect of the disclosure there is provided a protective sheet and dispenser assembly comprising:

- a plurality of elongate and separable sheets each (i) adapted to cover an exposed or shared surface of a patient support, and (ii) including one of a hook or loop component of a hook and loop fastener wherein said hook or loop component is integrated within an exposed surface of said elongate sheet; and a dispenser configured for housing and dispensing of the plurality of elongate and separable sheets, said dispenser including a plurality of securement members adapted to mount to the patient support, said securement members each including an opposite one of the hook or loop component of the hook and loop fastener, wherein the hook component is configured for releasable inter-engagement with the corresponding loop component thereby anchoring said elongate sheet to the patient support.

In aspects, the plurality of elongate and separable sheets are in the form of a dispensable roll including a plurality of tear lines each defined by a plurality of adjoining tear junctions configured for separating adjacent sheets of the elongate sheets from the roll. In embodiments, the dispenser includes severing means arranged for alignment with the adjoining tear junctions of adjacent sheets of the elongate sheets for tearing of each sheet from the roll. In one non-limiting embodiment, the dispenser includes capture means located adjacent the severing means and configured for releasable engagement of an associated elongate sheet to restrict retraction of said associated elongate sheet within the dispenser during dispensing of an adjacent sheet of the elongate sheets from the roll.

BRIEF DESCRIPTION OF DRAWINGS

In order to achieve a better understanding of the nature of the present disclosure a preferred embodiment of a protective sheet and securement assembly together with a protective sheet and dispenser assembly of alternative aspects of the disclosure will now be described, by way of example only, with reference to the accompanying drawings in which.

DETAILED DESCRIPTION

Figure 1:
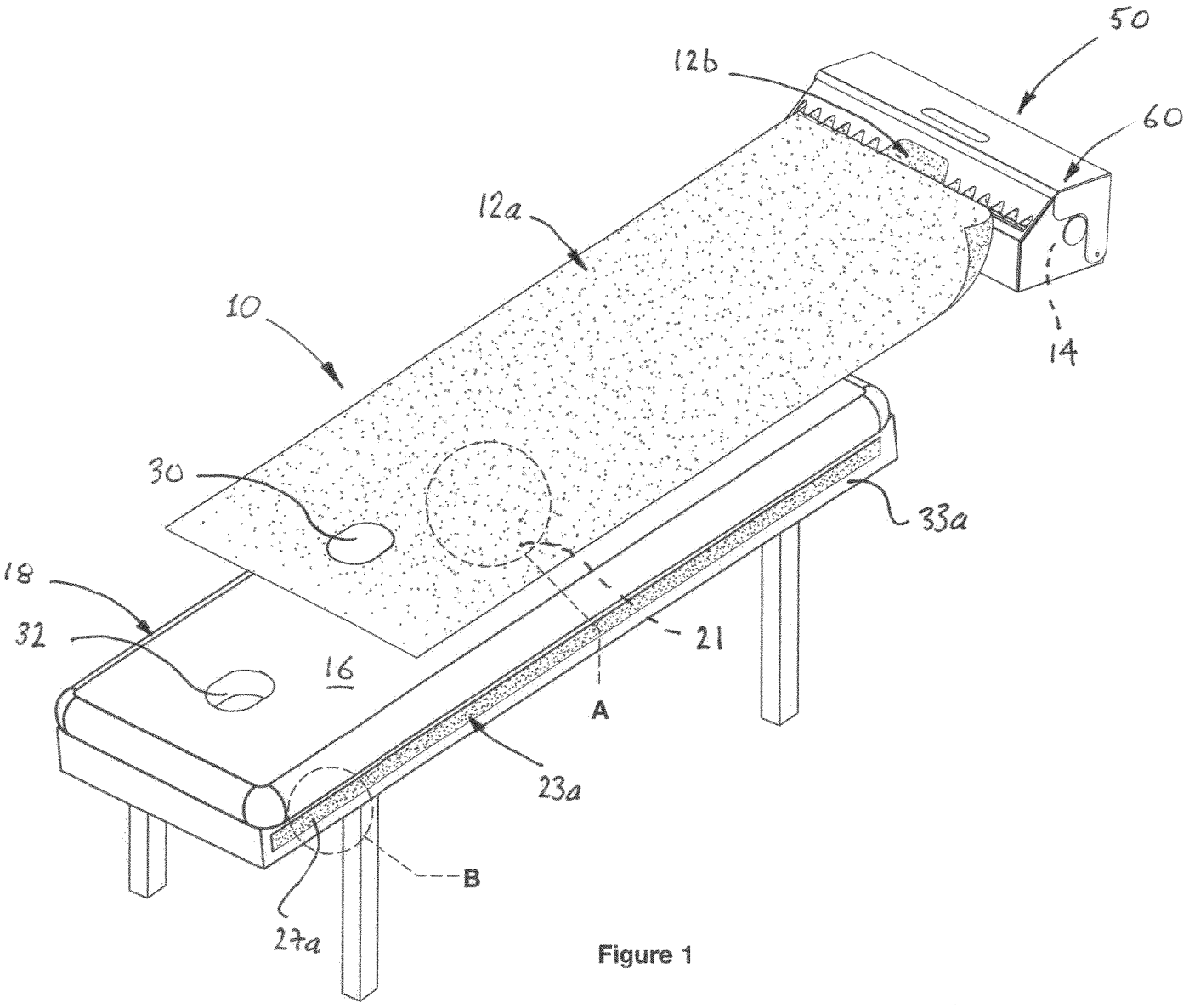
FIG. 1 is a perspective view from above of a first embodiment of a protective sheet and securement assembly as well as a protective sheet and dispenser assembly according to all aspects of the disclosure.

As seen in FIG. 1, there are three (3) embodiments of all aspects of the disclosure which is in first and second aspects broadly directed to a protective sheet and securement assembly 10, and in a third aspect broadly directed to a protective sheet and dispenser assembly 50. In the first and second aspects the assembly 10 may be limited to a single elongate sheet whereas the dispenser assembly 50 of the third aspect may comprise an elongate sheet such as 12*a* which is one of a plurality of sheets such as 12*a* and 12*b* provided in a dispensable roll 14 of separable sheets 12*a/b*. In the described embodiments, each of the sheets 12*a* is adapted to cover an exposed or shared upper surface 16 of a patent support such as a therapy bed 18. It is to be understood that the disclosure extends to other surfaces of patient supports typically used in a medical environment including but not limited to beds at a medical practice, hospital, or therapy environment.

FIG. 1 illustrates a first embodiment of a protective sheet and securement assembly 10 of the first and second aspects of the disclosure. The protective sheet and securement assembly broadly 10 comprises.

Figure 6:
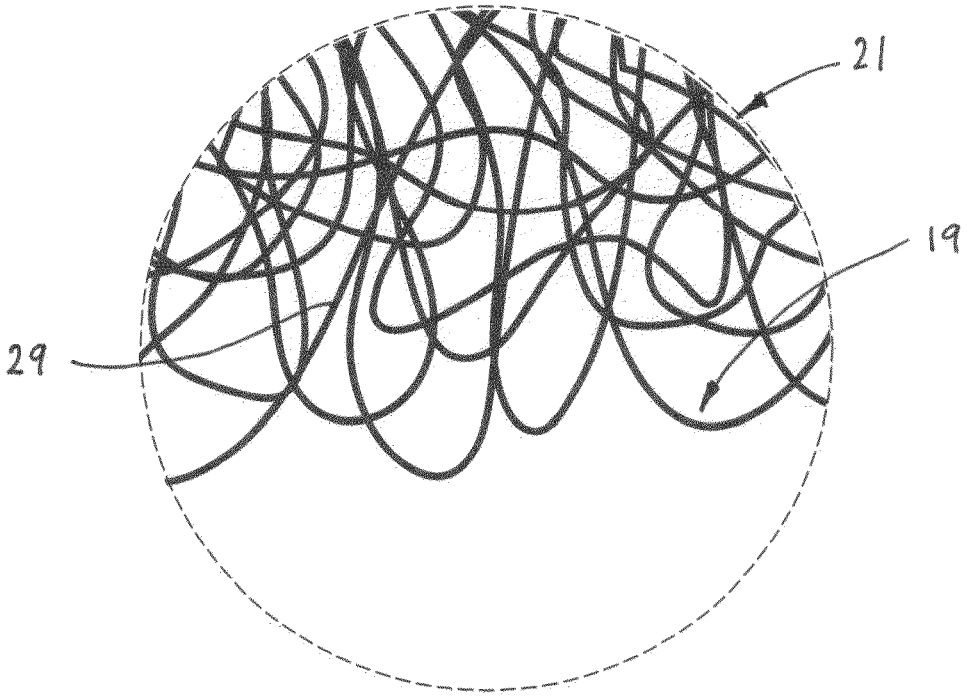
FIG. 6 is an enlarged sectional view taken from FIG. 5 depicting an entanglement of fibres together forming the loop component of the loop fastener of the elongate sheet of the protective sheet and securement assembly of the first embodiment according to first and second aspects of the disclosure.
Figure 7:
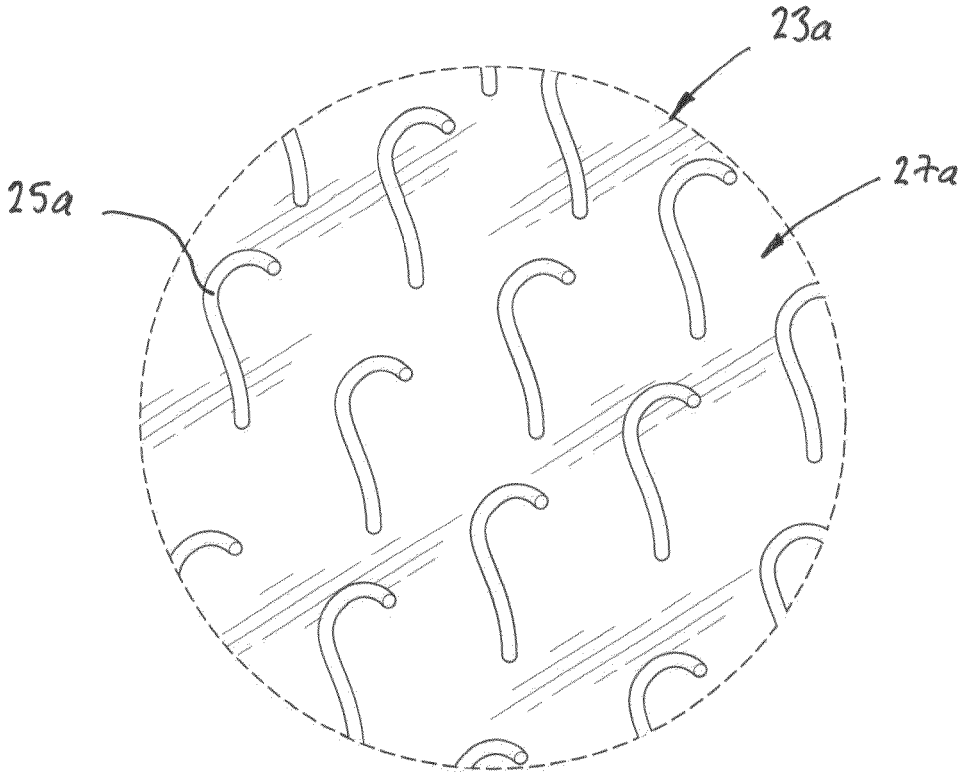
FIG. 7 is an enlarged view of detail B of the hook component of the hook fastener of the securement member of said sheet and securement assembly taken from FIG. 1 of the first embodiment according to first and second aspects of the disclosure.
Figure 8:
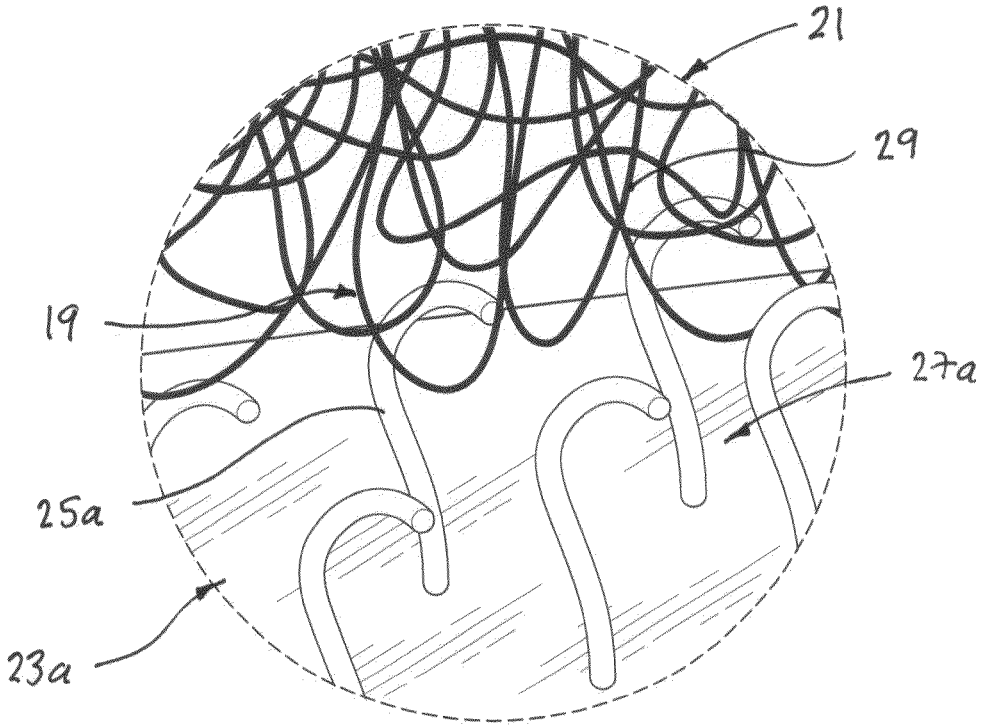
FIG. 8 is an enlarged sectional view taken from detail D of FIG. 3 of the second embodiment of the first and second aspects of the disclosure depicting inter-engagement of the hook and loop components of the elongate sheet and securement member respectively.
Figure 9:
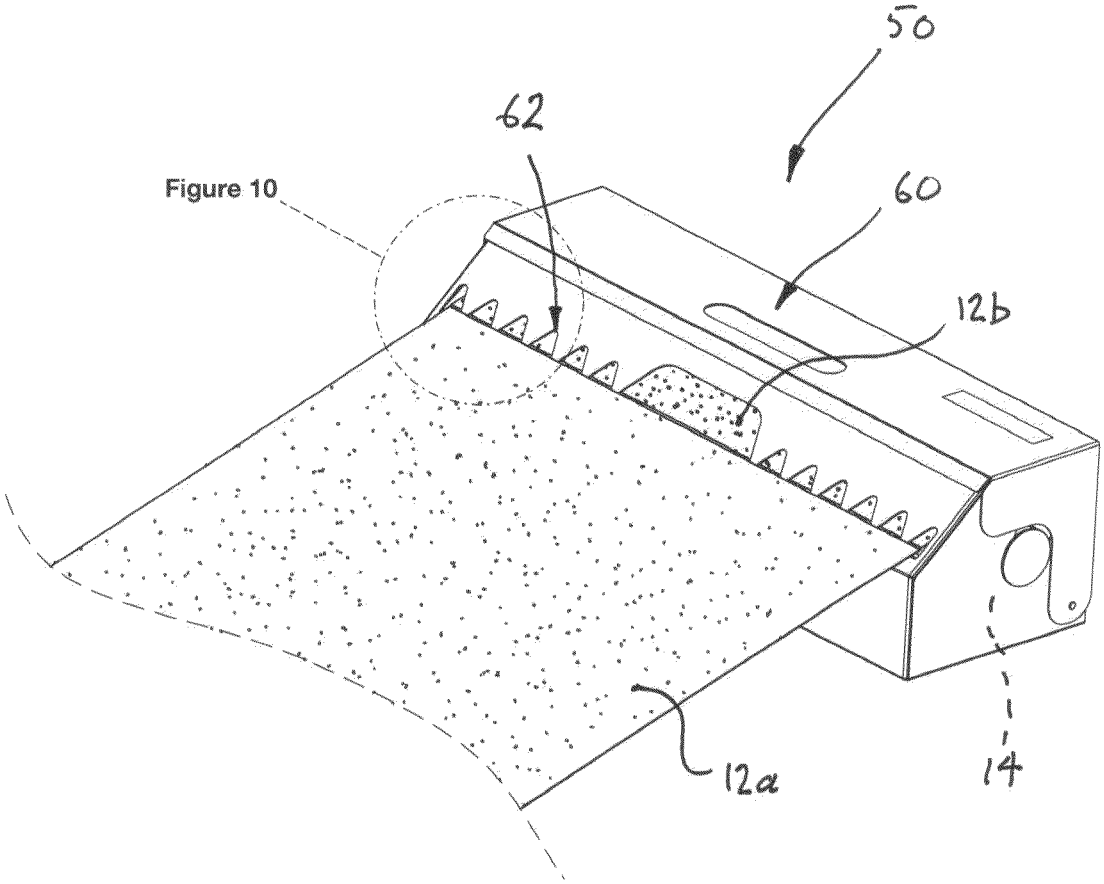
FIG. 9 is a perspective view of a first embodiment of a protective sheet and dispenser assembly according to the third aspect of the disclosure.

1. the elongate sheet such as 12*a* adapted to cover an exposed or shared surface 16 of the therapy bed 18, said elongate sheet 12*a* including a loop component 19 of a loop fastener 21 (see FIGS. 5 and 6) wherein said loop component 19 is integrated within an exposed surface of the elongate sheet 12*a*; and
2. a plurality of securement members designated generally at 23*a* adapted to mount to the patient support or therapy bed 18, said securement members 23*a* each including a hook component 25*a* (see FIGS. 7 and 8) of a hook fastener 27*a* being configured for releasable inter-engagement with the loop component 19 thereby anchoring the elongate sheet 12*a* to the therapy bed 18.

Figure 2:
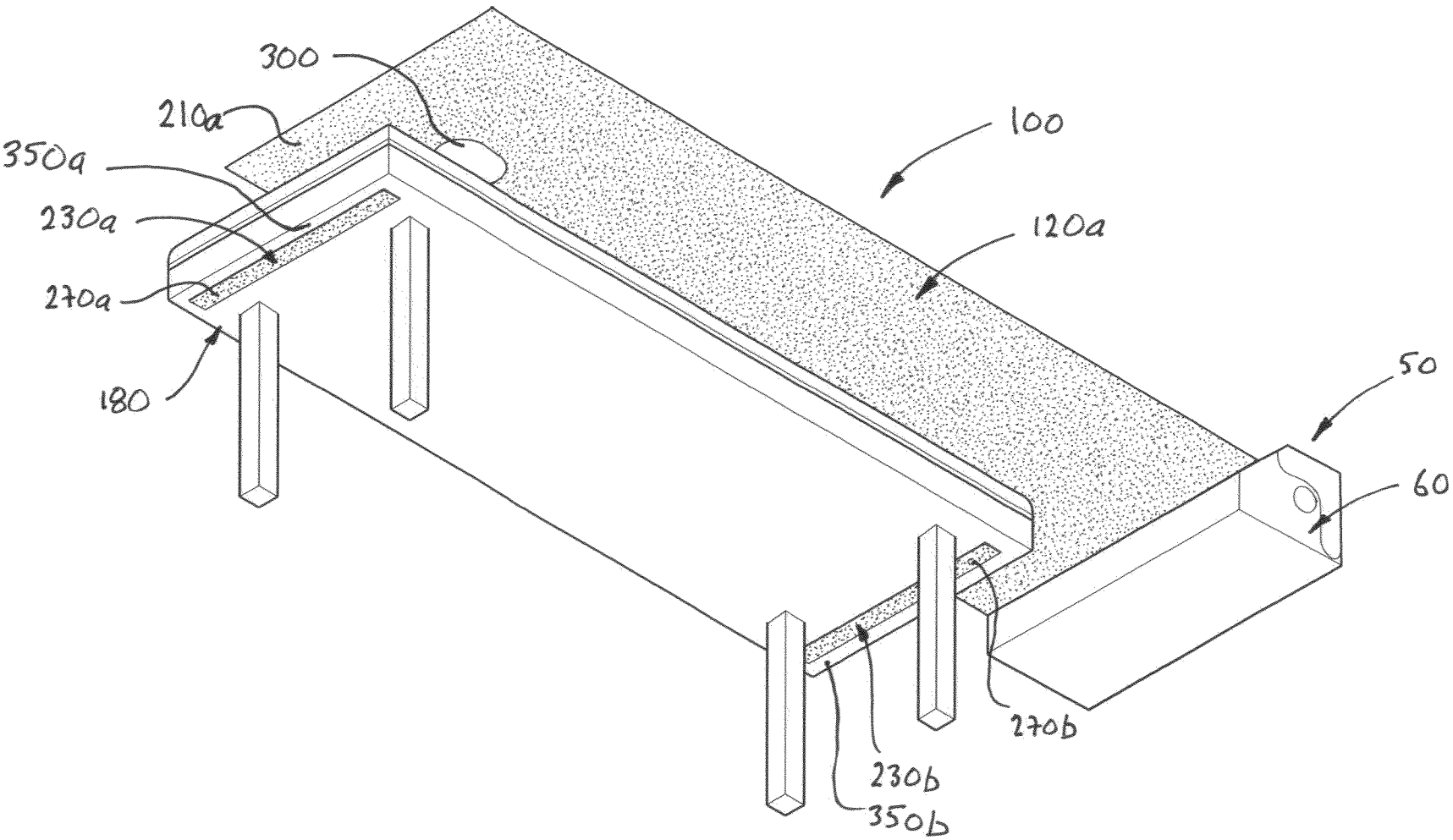
FIG. 2 is a perspective view from underneath of a second embodiment of a protective sheet and securement assembly according to first and second aspects of the disclosure.
Figure 3:
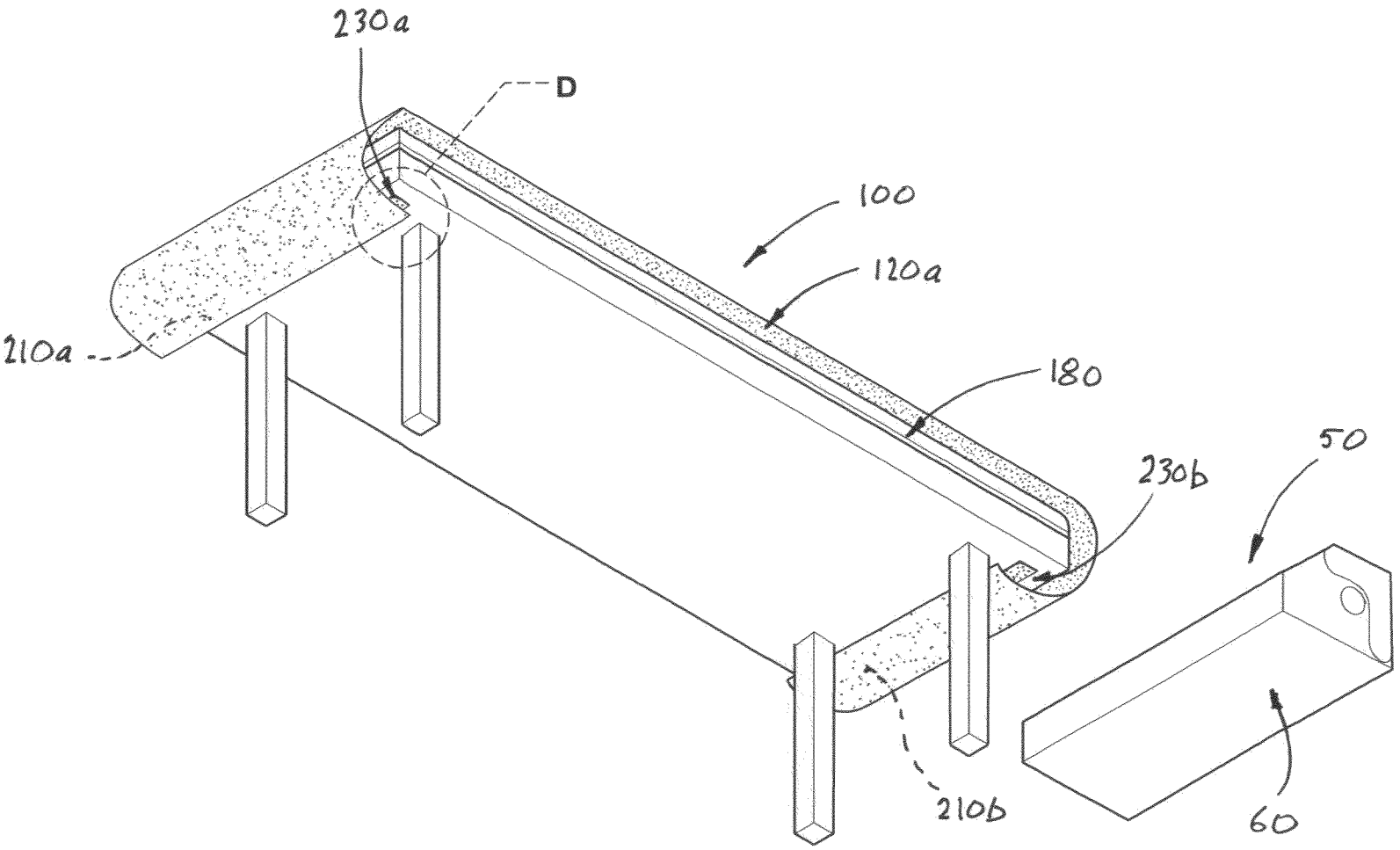
FIG. 3 is a perspective view from underneath of the second embodiment of the protective sheet and securement assembly of FIG. 2 shown fitted to a patient support.

FIG. 2 depicts a second embodiment of the first and second aspects of the protective sheet and securement assembly 100 being essentially the same as the first embodiment except for location of the securement members 230*a* and 230*b*. The securement members such as 23*a* of the first embodiment locate along longitudinal faces such as 33*a* of the bed 18 whereas the securement members such as 230*a* of the second embodiment locate on an underside surface such as 350*a* of the bed 180. For ease of reference and in order to avoid repetition like components of the second embodiment are referenced with an additional "0" vis a vis the first embodiment. FIG. 3 shows the elongate sheet 120*a* fitted to the patient support or bed 180 via the securement members 230*a* and 230*b*.

Figure 4:
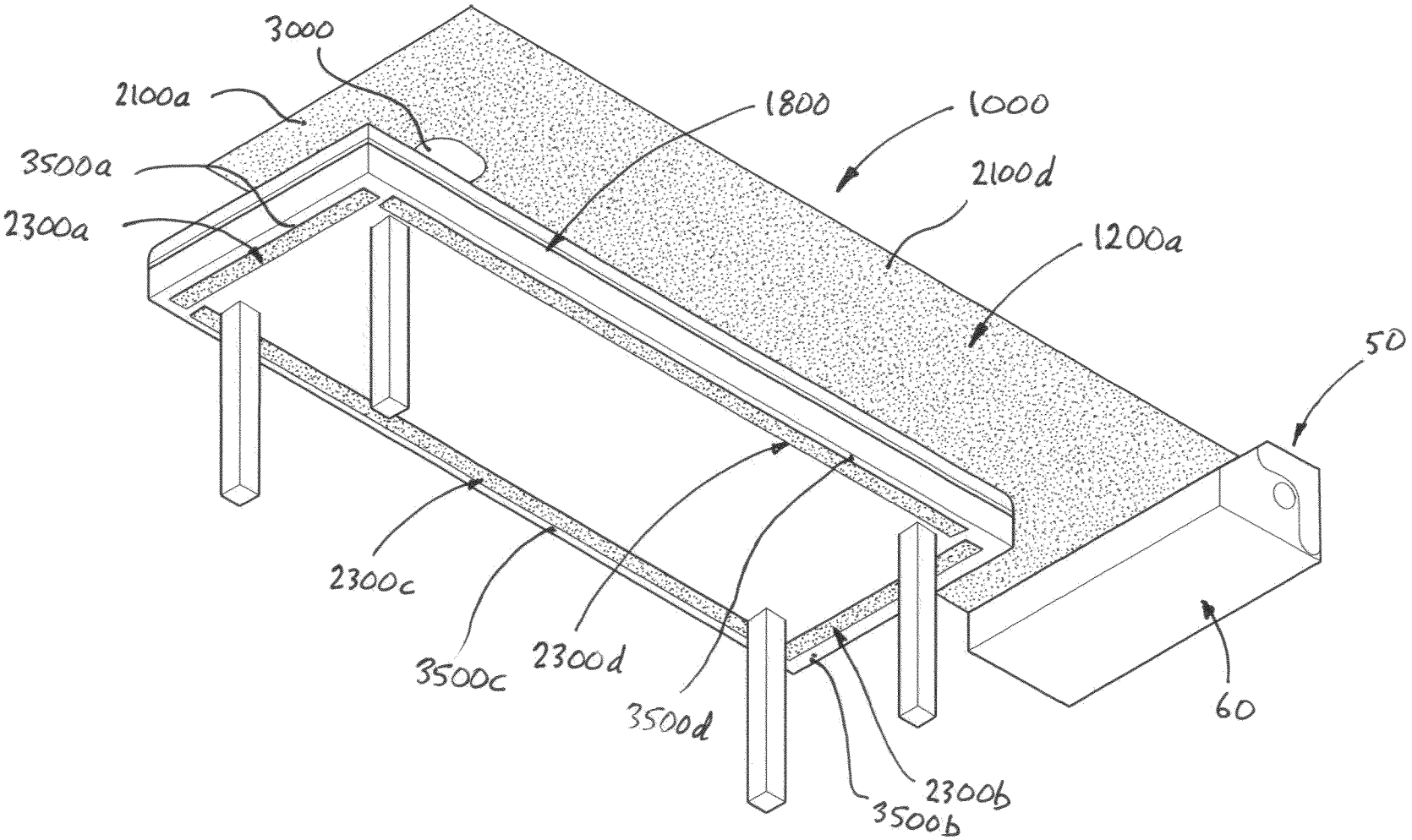
FIG. 4 is a perspective view from underneath of a third embodiment of a protective sheet and securement assembly according to first and second aspects of the disclosure.

FIG. 4 illustrates a third embodiment of the first and second aspects of the protection sheet and securement assembly 1000. In this example there are four (4) securement members 2300*a* to 2300*d* located on an underlying surface of the therapy bed 1800 about its perimeter. In order to avoid repetition like components of the third embodiment are indicated with an additional "00" vis a vis the first embodiment.

In all embodiments of the first and second aspects, the integrated loop component such as 19 of the elongate sheet 12*a* occupies substantially all of both of the opposing exposed surfaces of said sheet 12*a*. As best seen in FIGS. 5 to 8, the integrated loop component 19 of the loop fastener 21 of the sheet 12*a* includes entangled fibres 29 of a relatively fine construction. The integrated loop component 19 is thus effective in inter-engagement with the hook component such as 25*a* of the securement members 23*a*.

The securement members 23*a* are in these embodiments in the form of securement strips such as 24*a* including the hook component 25*a* integrated within one of its opposing faces. It is to be understood that the hook component 25*a* is of a relatively coarse construction compared with the relatively fine loop component 19 of the elongate sheet 12*a*. In alternative embodiments, the hook and loop components of the hook and loop fasteners may be reversed wherein the hook component is integrated within an exposed surface of the elongate sheet, and the loop component is included in the securement member adapted for mounting to the patient support.

Returning to the preferred embodiments, it is to be understood that the population density of entangled fibres 29 of the loop component 19 greatly outweighs the corresponding population density of the hook component such as 25*a*. In the embodiments described, the population density of the loop component 19 is between approximately 10 to 100 per square millimetre of the exposed surface of the elongate sheet 12*a* whereas the population density of the hook component 25*a* is between approximately 2 to 6 per square millimetre. It is to be understood that the relatively coarse and low density hook component such as 25*a* is particularly effective in inter-engagement with corresponding of the relatively fine and high density entangled fibres 29 of the loop component such as 19.

In these embodiment the securement strips 24*a* include a self-adhesive layer for mounting to the patient support or therapy bed 18. In alternative arrangements the securement strips 24*a* may be fastened or adhered to the patient support 18 via staples or other fasteners, or via glue or other adhesive materials.

In each embodiment of all aspects of the disclosure, the elongate sheet such as 12*a* is formed in one piece from a recyclable and non-woven material which is typically disposable. The recyclable material is in this example formed in multiple layers and is of a combined material density which is effective in bacterial filtration, for example the combined layers of the material has a density of around 28 GSM.

The sheet 12*a* is hot-rolled from multiple layers including at least one meltblown layer having the entangled fibres 29 which at least in part form the integrated loop component such as 19 of the elongate sheet 12*a*. In the embodiments described the elongate sheet 12*a* is hot-rolled from opposing spunbound layers sandwiched or sandwiching either side of the meltblown layer. In an alternative construct the elongate sheet 12*a* may be hot rolled from opposing spunbound layers sandwich or sandwiching either side of a pair of the meltbown layers. It is to be understood that the sheet may be of a different construction including different combinations of non-woven layers. In alternative embodiments the sheet may be biodegradable and for example manufactured from plant-based fibres.

Figure 5:
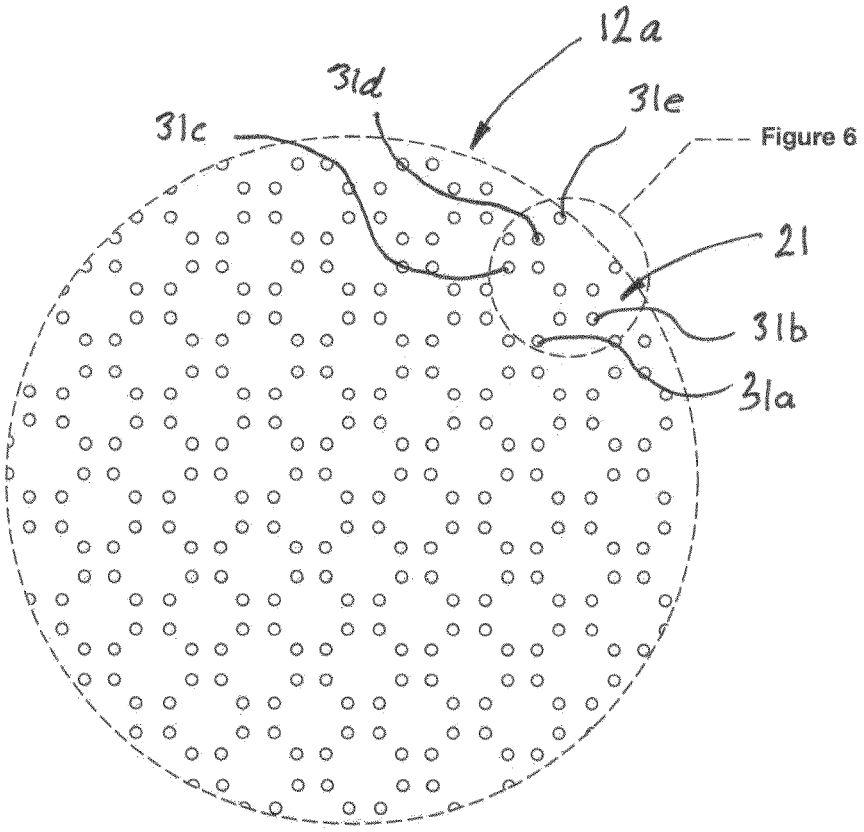
FIG. 5 is an enlarged view of detail A taken from FIG. 1 of an underlying surface of the protective sheet and securement assembly of the first embodiment according to first and second aspects of the disclosure.

As seen in FIG. 5, in these embodiments the multiple layers are at least in part melted together via discrete melt regions such as 31*a* to 31*e* occupying a reduced area of the exposed surface of the elongate sheet 12*a*. this means the effective population of entangled fibres of the loop component of the sheet 12*a* is increased thereby promoting inter-engagement with the hook component 25*a* of the securement member 23. The discrete melt regions 31*a* to 31*e* are shown schematically as small dots in the enlarged detail view of the elongate sheet 12*a* of FIG. 5. In there embodiments the melt regions such as 31*a* together occupy about 5 to 20% of the surface area of the elongate sheet 12*a*.

The elongate sheet 12*a* of this embodiment includes a face hole opening 30 which aligns with a corresponding face hole opening 32 in the therapy bed 18. In this scenario the sheet 12*a* may cooperate with a face sheet (not shown) which fits about the face opening 30 and drapes within the face opening 32. This optional face sheet provides additional coverage for exposed surfaces surrounding the face opening 32 of the therapy bed 18 while a patient or client is lying prone or face down. The optional face sheet is constructed in accordance with the applicant's related technology disclosed in their Australian standard patent application no. 2017202118 and related applications. The disclosures and teachings of this Australian patent application are to be included herein by way of this reference. It is to be understood that, depending on the application to which it is applied, the elongate sheet may be formed with or without a face hole opening.

FIGS. 9 to 13 best illustrate an embodiment of the protective sheet and dispenser assembly 50 according to the third aspect of the disclosure. The protective sheet and dispenser assembly 50 generally comprises:

1. a plurality of elongate and separable sheets such as 12*a* and 12*b* each (i) adapted to cover an exposed or shared surface of a patient support, and (ii) including a loop component such as 19 of a loop fastener 21 integrated within an exposed surface of the elongate sheet such as 12*a*; and
2. a dispenser 60 configured for housing and dispensing of the plurality of elongate and separable sheets 12*a* and 12*b*, said dispenser 60 including a plurality of securement members (not shown) each including a hook component 25*a* of a hook fastener 27*a* wherein the hook component 25*a* is configured for releasable inter-engagement with corresponding of the loop component 19 thereby anchoring said elongate sheet such as 12*a* to the patient support.

In this embodiment the separable elongate sheets such as 12*a/b* are in the form of a dispensable roll 14 including a plurality of tear lines such as 52*ab*. Each of the tear lines such as 52*ab* is defined by a plurality of tear junctions such as 54*ab*.1 and 54*ab*.2 (see FIG. 10) for adjacent of the separable sheets 12*a/b* from the roll 14.

Figure 10:
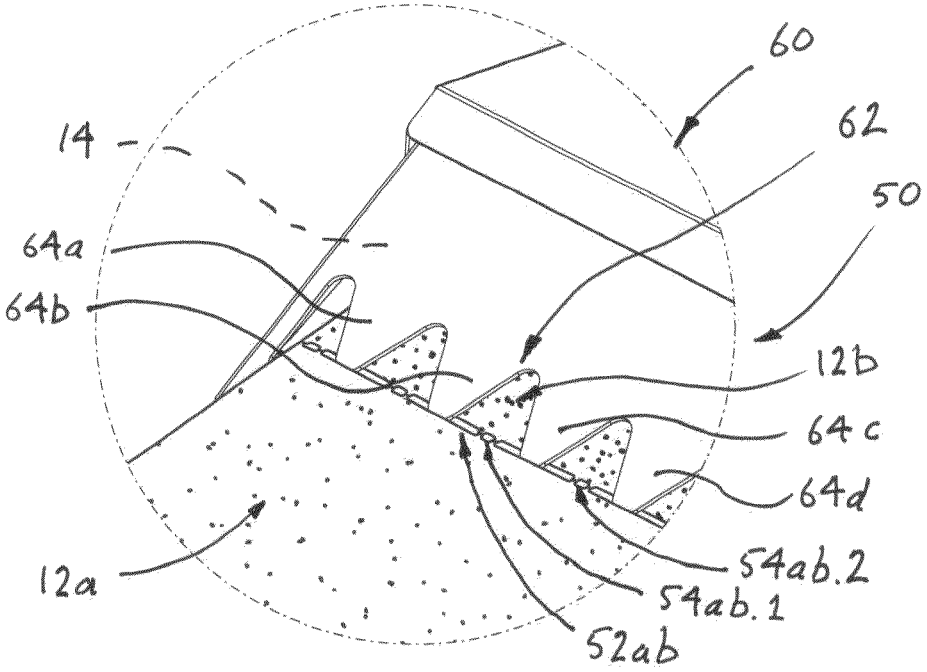
FIG. 10 is an enlarged view taken from FIG. 9 of the first embodiment of the third aspect of the disclosure.

As seen in FIG. 10, the sheet dispenser 60 of this embodiment includes severing means 62 which includes a series of teeth such as 64*a* to 64*d* arranged for engagement with the dispensable roll 14 across one of the tear lines such 52*ab*. The teeth such as 64*c* locate between neighbouring of the adjoining tear junctions such 54*ab*.1 and 54*ab*.2 to facilitate tearing of the sheets in this instance 12*a* from the adjacent sheet 12*b* of the roll 14. Each of the adjoining tear junctions such 54*ab*.1 includes a plurality of frangible tear points such as 56*ab*.1.1 and 54*ab*.1.2 (see FIG. 13). The assembly 50 is designed for manual withdrawal of the sheet such as 12*a* from the dispenser 60. The dispenser automatically separates the sheets 12*a* and 12*b* when the tear line 52*ab* aligns with the severing means 62 and continued manual withdrawal of the sheet 12*a* forces the teeth such as 64*c* into tearing engagement with neighbouring tear junctions 54*ab*.1 and 54*ab*.2 for tearing of said junctions.

Figure 11:
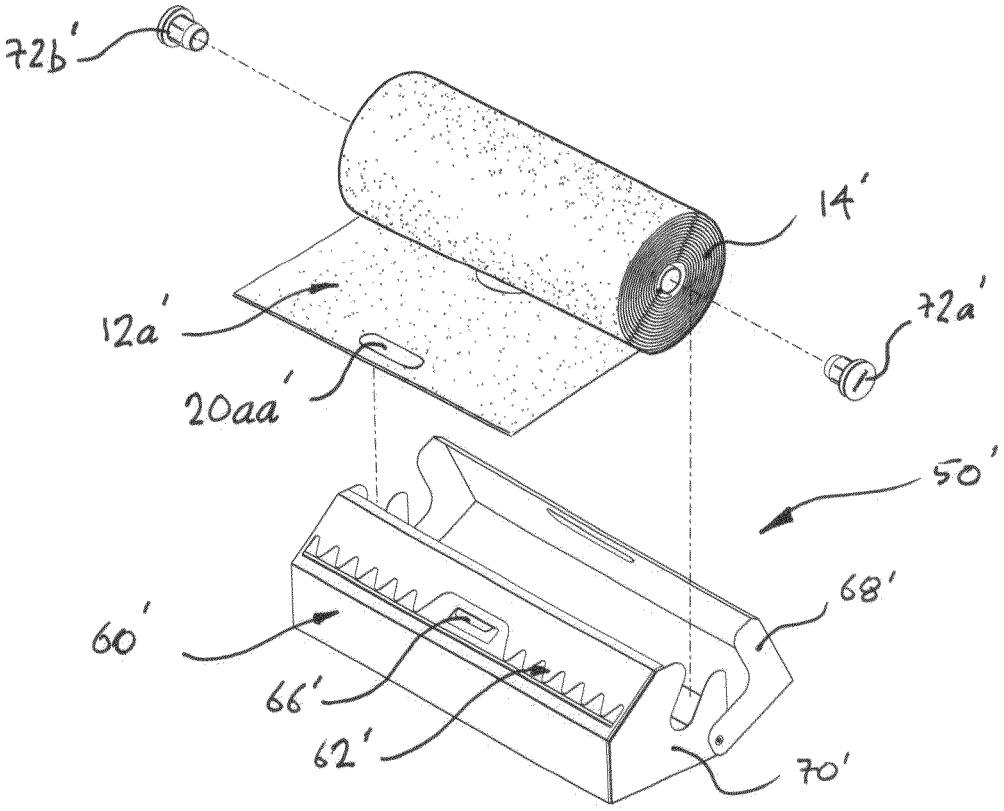
FIG. 11 is a perspective view of a second embodiment of the third aspect of the disclosure showing a dispensable roll of separable elongate sheets removed from an associated sheet disclosure.
Figure 12:
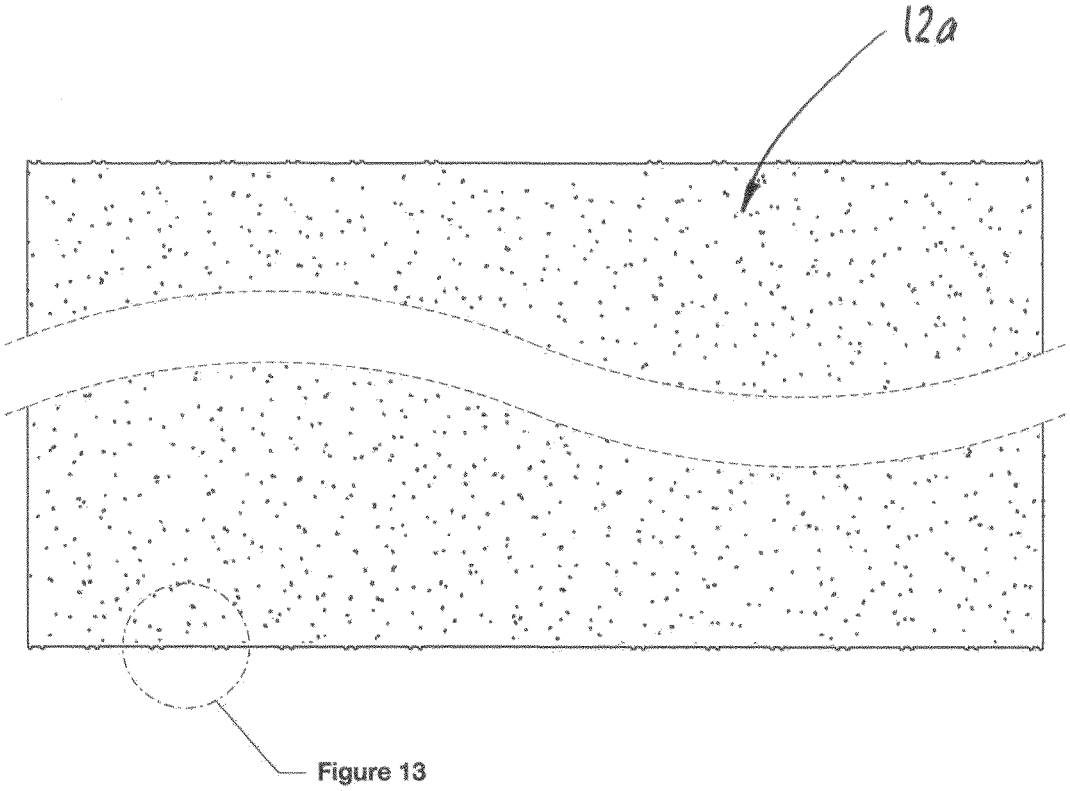
FIG. 12 is a plan view of one of the plurality sheets taken from a dispensable roll of the first embodiment of all aspects of the disclosure and being shown broken longitudinally to indicate its indefinite extent.
Figure 13:
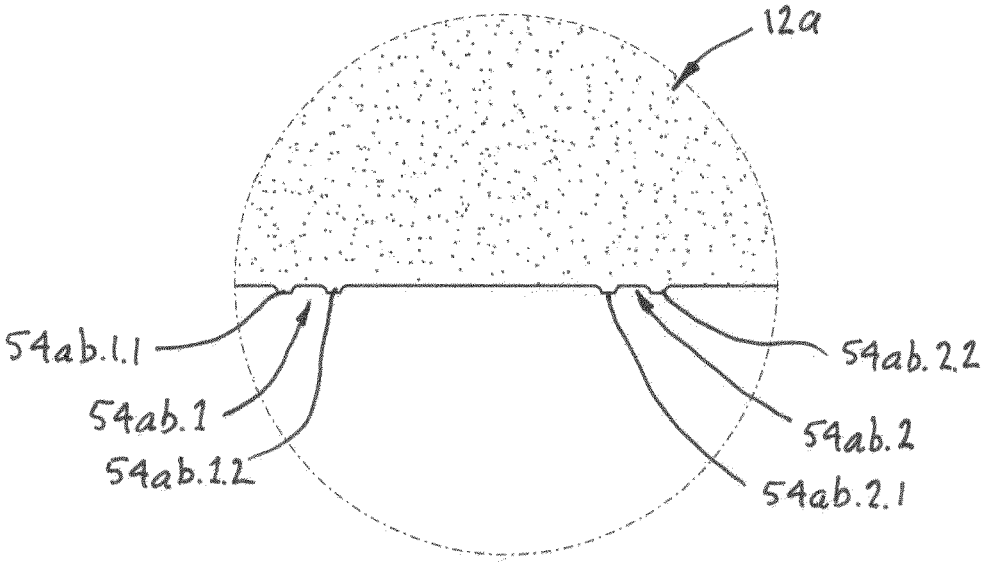
FIG. 13 is an enlarged view taken from FIG. 12 of the first embodiment of the elongate sheet of all aspects of the disclosure.

As seen in FIG. 11, there is an alternative embodiment of a sheet dispenser 60' including capture means in the form of a fixed latching member 66' aligned with the severing means 62' and configured for releasable engagement of one of a pair of securement openings such as 20*aa*' associated with the sheet 12*a*'. It is to be understood that this releasable engagement of the securement opening or aperture 20*aa*' restricts retraction of the associated sheet 12*a*' within the dispenser 60' during dispensing of the preceding sheet (not shown) from the roll 14'. In the event the sheet 12*a*' is latched by the latching member 66', it can with relative ease be extracted from the dispenser 60' by grabbing the aperture such as 20*aa*' and drawing the associated sheet 12*a*' outward of the dispenser 60' whereupon it is released from the latching member 66'.

FIG. 11 also schematically illustrates loading of the dispensable roll 14' of the separable elongate sheets such as 12*a*' into the sheet dispenser 60'. The sheet dispenser 60' includes a hinged lid 68' which is folded outward of an associated housing 70' in its open configuration. In this open configuration, the roll 14' is lowered inside the housing 70' and retained for rolling within the housing 70' via retractable roller plugs 72*a*' and 72*b*'. The outermost of the sheets 12*a*' is fed underneath the severing means 62' in readiness for dispensing of elongate sheets such as 12*a*'. The hinged lid 68' is then moved into its closed configuration to enclose the roll 14'.

Now that an embodiment of the alternative aspects of the disclosure have been described it will be apparent to those skilled in the art that they have at least the following advantages:

1. the elongate sheet is configured for releasable engagement with securement means associated with a patient support for quick and convenient coverage of the patient support and its exposed and/or shared surfaces;
2. the sheet is relatively inexpensive to manufacture by automated tooling which lends itself to scale production;
3. the elongate sheet includes integrated loop or hook fasteners which cooperate with securement means including corresponding hook or loop fasteners mounted to the patient support without relying upon fixtures or clips;
4. the protective sheet and securement assembly provides effective fitting to the therapy bed without incorporating elastic, mixed materials or other non-disposable or non-recyclable means incorporated within the fitted sheet;
5. the sheet cooperates with the securement members displaying relatively weak peel strength for easy pull removal whilst offering relatively strong shear strength thus retaining the sheet on the patient support under translational or sliding forces;
6. the securement means provide relatively simple and functionally effective means for anchoring the elongate sheet without requiring fixture or clip arrangements;
7. the protective sheet and dispenser assembly provides relatively quick and effective means for dispensing and separating elongate sheets at predetermined lengths.

Those skilled in the art will appreciate that the embodiments described herein is susceptible to variations and modifications other than those specifically described. For example, the population density or construct of the hook and/or loop fasteners may vary from that described provided the loop or hook fastener associated with the elongate sheet is integrated within the sheet. The hooks may be multi-directional in a symmetrical or asymmetrical arrangement and the hooks may each include multiple rather than a single prong. It is understood that the multi-directional hooks will increase the shear strength of the hook fastener. In a departure from the hook/loop style fastener, the fastener may resemble a mushroom-style reclosable fastener integrated with the sheet and associated with the patient support. It is also possible that the loop/hook fastener of the sheet may occupy one exposed surface only and/or a perimeter region only of the sheet. The melted regions of the preferred sheet may form a different pattern to that illustrated provided it occupies a reduced surface area so as not to compromise inter-engagement of the sheet with the securement members. The securement members may take the form of a series of discrete members rather than elongate strips and may be appropriately mounted to the bed or other patient support without being restricted to the locations of the described embodiments. The form of the severing means of the sheet dispenser may vary depending on the construction of the tear line in adjoining sheets of the roll. The dispenser assembly may be rigidly mounted to a floor or wall adjacent the bed or, depending on the weight of the assembly, merely placed on the floor without any anchorage. Alternatively the dispenser assembly may be associated with or mounted to the bed itself.

All such variations and modifications are to be considered within the scope of the present disclosure the nature of which is to be determined from the foregoing description.

What is claimed is:

1. A protective sheet and securement assembly comprising:

an elongate sheet adapted to cover an exposed or shared surface of a patient support, said elongate sheet including a loop component of a hook and loop fastener wherein said loop component is integrated within an exposed surface of said elongate sheet; and a plurality of securement members adapted to mount to the patient support, said securement members each including a hook component of the hook and loop fastener, wherein the hook component is configured for releasable inter-engagement with the corresponding loop component thereby anchoring said elongate sheet to the patient support;

wherein the integrated loop component of the elongate sheet occupies substantially all of one or both of the exposed surfaces of said sheet;

wherein the elongate sheet further includes discrete melt regions occupying a reduced area of the exposed surface of the elongate sheet including the integrated loop component.

2. The protective sheet and securement assembly as claimed in claim 1 wherein said integrated hook or loop component is an integrated loop component including entangled fibres being of a relatively fine construction for effective inter-engagement with the hook component of the securement members.

3. The protective sheet and securement assembly as claimed in claim 2 wherein a population density of entangled fibres of the loop component per square millimetre of the exposed surface of the elongate sheet is between approximately 10 to 100.

4. The protective sheet and securement assembly as claimed in claim 2 wherein the securement members are in the form of securement strips including the hook component integrated within one of its opposing faces.

5. The protective sheet and securement assembly as claimed in claim 4 wherein the hook component is of a relatively coarse construction compared with a relatively fine loop component of the elongate sheet.

6. The protective sheet and securement assembly as claimed in claim 4 wherein the securement strips are each adapted for adhesion to the patient support via adhesive materials.

7. The protective sheet and securement assembly as claimed in claim 4 wherein the population density of the hook component per square millimetre of the securement members is between approximately 2 to 6.

8. The protective sheet and securement assembly as claimed in claim 4 wherein an other of the opposing faces of the securement strips includes a self-adhesive layer for mounting of said strip to the patient support.

9. The protective sheet and securement assembly as claimed in claim 4 wherein the securement strips are each adapted for fastening to the patient support via fasteners.

10. The protective sheet and securement assembly as claimed in claim 1 wherein the elongate sheet is formed in one piece from a recyclable and non-woven material.

11. The protective sheet and securement assembly as claimed in claimed 10 wherein the recyclable material is disposable and effective in bacterial filtration.

12. The protective sheet and securement assembly as claimed in claim 11 wherein said sheet is hot-rolled from multiple layers including at least one meltblown layer including the entangled fibres at least in part forming the integrated loop component of the elongate sheet.

13. The protective sheet and securement assembly as claimed in claim 12 wherein the multiple layers are at least in part melted together via discrete melt regions occupying a reduced area of the exposed surface of the elongate sheet including the integrated loop component thereby increasing an effective population of loop components for inter-engagement with the hook component of the securement members.

14. The protective sheet and securement assembly as claimed in claim 12 wherein said elongate sheet is hot-rolled from opposing spunbound layers sandwiching either side of the meltblown layer.

15. The protective sheet and securement assembly as claimed in claim 12 wherein said elongate sheet is hot-rolled from opposing spunbound layers sandwiching either side of a pair of the meltblown layers.

16. A protective sheet and dispenser assembly comprising:

a plurality of elongate and separable sheets each (i) adapted to cover an exposed or shared surface of a patient support, (ii) including one of a loop component of a hook and loop fastener wherein said loop component is integrated within an exposed surface of said elongate sheet, and (iii) discrete melt regions occupying a reduced area of the exposed surface of the elongate sheet including the integrated loop component; and a dispenser configured for housing and dispensing of the plurality of elongate and separable sheets, said dispenser including a plurality of securement members adapted to mount to the patient support, said securement members each including a hook component of the hook and loop fastener, wherein the hook component is configured for releasable inter-engagement with the corresponding loop component thereby anchoring said elongate sheet to the patient support.

17. The protective sheet and dispenser assembly as claimed in claim 16 wherein the plurality of elongate and separable sheets are in the form of a dispensable roll including a plurality of tear lines each defined by a plurality of adjoining tear junctions configured for separating adjacent sheets of the plurality elongate sheets from the roll.

18. The protective sheet and dispenser assembly as claimed in claim 17 wherein the dispenser includes severing means arranged for alignment with the adjoining tear junctions of adjacent sheets of the plurality of elongate sheets for tearing of each said sheet from the roll, wherein the dispenser includes capture means located adjacent the severing means and configured for releasable engagement of an associated elongate sheet to restrict retraction of said associated sheet within the dispenser during dispensing of an adjacent sheet of the plurality of elongate sheets from the roll.

* * * * *